US006857696B2

(12) United States Patent
Usagani

(10) Patent No.: US 6,857,696 B2
(45) Date of Patent: Feb. 22, 2005

(54) MULTI-FUNCTIONAL FURNITURE

(76) Inventor: Ben Usagani, Jl. Jupiter 1A/2, Villa Cinere Mas, Jakarta, Indonesia 15419 (ID)

( * ) Notice: Subject to any disclaimer, the term of this patent is extended or adjusted under 35 U.S.C. 154(b) by 0 days.

(21) Appl. No.: 10/418,471

(22) Filed: Apr. 17, 2003

(65) Prior Publication Data

US 2003/0221593 A1 Dec. 4, 2003

Related U.S. Application Data

(60) Provisional application No. 60/374,088, filed on Apr. 18, 2002.

(51) Int. Cl.[7] ..... A47D 1/08; A47C 13/00

(52) U.S. Cl. ..... 297/1; 297/119; 297/172; 297/271.6

(58) Field of Search ..... 297/1, 2, 3, 118, 297/119, 172, 271.5, 271.6

(56) References Cited

U.S. PATENT DOCUMENTS 1,441,940 A * 1/1923 Nafe ..... 472/114
2,269,834 A * 1/1942 Wagner ..... 297/2
2,440,979 A * 5/1948 Schneider ..... 297/3
3,556,586 A * 1/1971 Beardmore ..... 297/3
3,879,083 A * 4/1975 Olsson ..... 297/1
4,205,876 A * 6/1980 Cetina ..... 297/118
4,241,949 A * 12/1980 Parker ..... 297/3
5,382,072 A * 1/1995 Diefenbach ..... 297/1
5,415,454 A * 5/1995 Fu-Tsung ..... 297/3
6,367,874 B2 * 4/2002 Casini ..... 297/118
2003/0218365 A1 * 11/2003 Kawiaka ..... 297/118

* cited by examiner

*Primary Examiner*—Peter R. Brown
(74) *Attorney, Agent, or Firm*—Sheridan Ross P.C.

(57) ABSTRACT

The present invention describes a furniture unit or a toy which employs base, top, and curved members along with a support member which extends along the inner surfaces of the top, base, and curved members. The shape of the invention allows it to be selectively positioned such that it can be adapted for a plurality of uses. For example, one embodiment of the present invention may be adapted for use as a desk, sofa, chair, or rocking toy.

20 Claims, 5 Drawing Sheets

MULTI-FUNCTIONAL FURNITURE

This application claims priority from U.S. provisional patent application Ser. No. 60/374,088, filed Apr. 18, 2002, entitled MULTI-FUNCTIONAL FURNITURE, which is incorporated by reference in its entirety herein.

FIELD OF THE INVENTION

The present invention relates generally to furniture and more specifically to children's furniture which is easily positionable and multi-functional.

BACKGROUND OF THE INVENTION

As people grow and develop, their needs in terms of furniture and play toys change. The cost of outfitting a room with toys and furniture to satisfy each developmental stage can be expensive. Thus, it is desirable to provide furniture and toys for children which are adapted to accommodate several developmental stages.

Many convertible or multi-functional items of furniture are known in the art, however many suffer from one or more of the following drawbacks: relatively high expense, bulky or unattractive appearance; use of a large number of parts requiring time and/or tools to convert from one configuration to another; difficulty in conversion, and difficulty in adjusting for the sizes of children as they grow. All of these failings detract from the suitability of some furniture units and defeat the original purpose of providing versatile multi-functional furniture which is inexpensive and easy to transform from one use to the next thereby saving time. Thus, there is a significant need for multi-functional furniture which can be used for numerous applications and can be placed in a variety of settings.

SUMMARY OF THE INVENTION

It is one aspect of the present invention to provide a furniture unit that is easily converted into a plurality of different configurations such as a desk, a chair, a rocking chair, a two-person sofa, or any other sitting, playing, or resting apparatus. One embodiment of the invention includes at least a base, top, and curved members along with a support member which extends along inner surfaces of the top, base, and curved members. Preferably the top and the base are the same width, but the length of the top is slightly less than the length of the base.

The furniture unit may be adapted to be used as a chair when the furniture is placed on the floor such that the base is adjacent to the floor, wherein the user places his or her back against the top. In this same orientation, the user can turn around and face the top of the invention, thus using the invention as a desk and chair combination. Although throughout this specification the unit is described as being placed adjacent to a "floor", one skilled in the art will appreciate that the unit will behave as described herein, with varying degrees of efficiency, when placed on any surface capable of supporting weight, such as sand, grass, carpeting, tile, wood, concrete, etc.

Alternatively, the curved member of one embodiment of the present invention may be placed adjacent to the floor wherein the unit will be adapted to move in a rhythmic, swaying motion, much like a rocking horse, for example. More specifically, to orient the unit as a rocking toy, the curved member is placed adjacent to the floor wherein the unit is easily rocked by the user or by another.

To transfer the invention into a sofa or chair it is oriented such that one side of the curved, base and top members are adjacent to the floor, wherein one or more users can rest on the support member. As it will be apparent to one skilled in the art, these examples are only a few of the possible orientations a furniture unit as described herein can take. In short, with the present invention, the functions of the unit are limited only by the user's imagination.

It is another aspect of the present invention to provide a multi-functional piece of furniture for a user which has a minimum of parts and no assembly required. More specifically, one embodiment of the present invention is constructed from a molded material, such as fiberglass, plastic, carbon fiber composite, or any other moldable material or combinations thereof. As it is evident to one skilled in the art, the present invention may be adapted to be constructed of a single piece of said moldable material. Alternatively, the major components of the present invention may be adapted to be selectively interconnected to perhaps facilitate transportation, storage, repair, or expansion by selective interconnection of additional pieces, among other things. These and other aspects, features, and advantages of the invention will become apparent from the following description, drawings and claims.

Thus, it is one aspect of the present invention to provide a multi-functional furniture unit that is easily manipulated into a plurality of orientations and does not require complicated set-up or manipulation comprising:

a base member having an inner surface, and an outer surface;

a top member having an inner surface and an outer surface;

a curved member which operably interconnects said base member to said top member, said curved member having an inner surface and an outer surface; and a support member interconnected to said inner surface of said base, said inner surface of said curved member, and said inner surface of said top member, wherein said furniture unit is adapted to provide a user a chair, a sofa or a rocking toy depending on the orientation of the unit.

DETAILED DESCRIPTION

Figure 1:
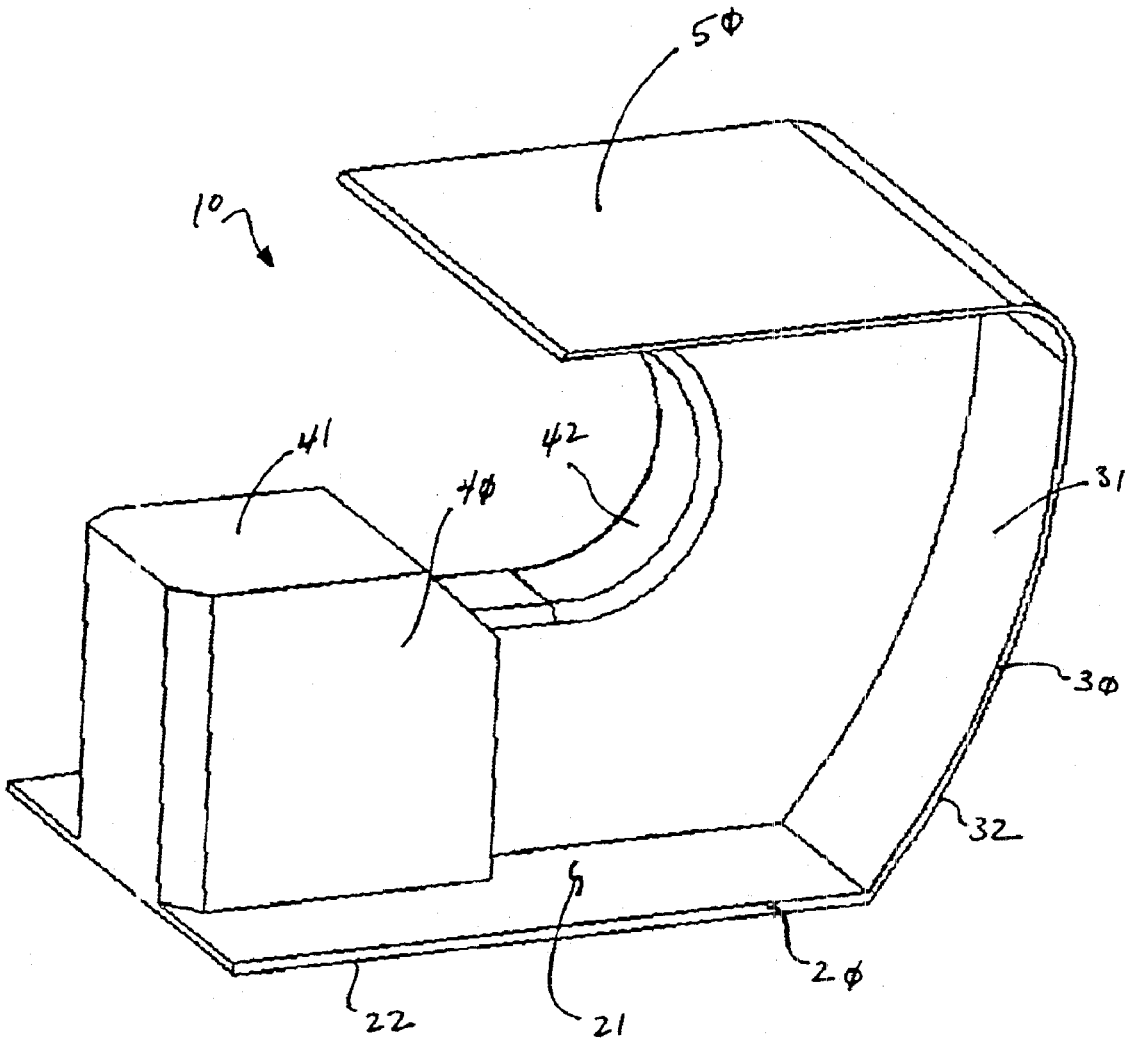
FIG. 1 is a right front perspective view of one embodiment of the present invention, shown in the orientation to be used as a desk or a chair.
Figure 2:
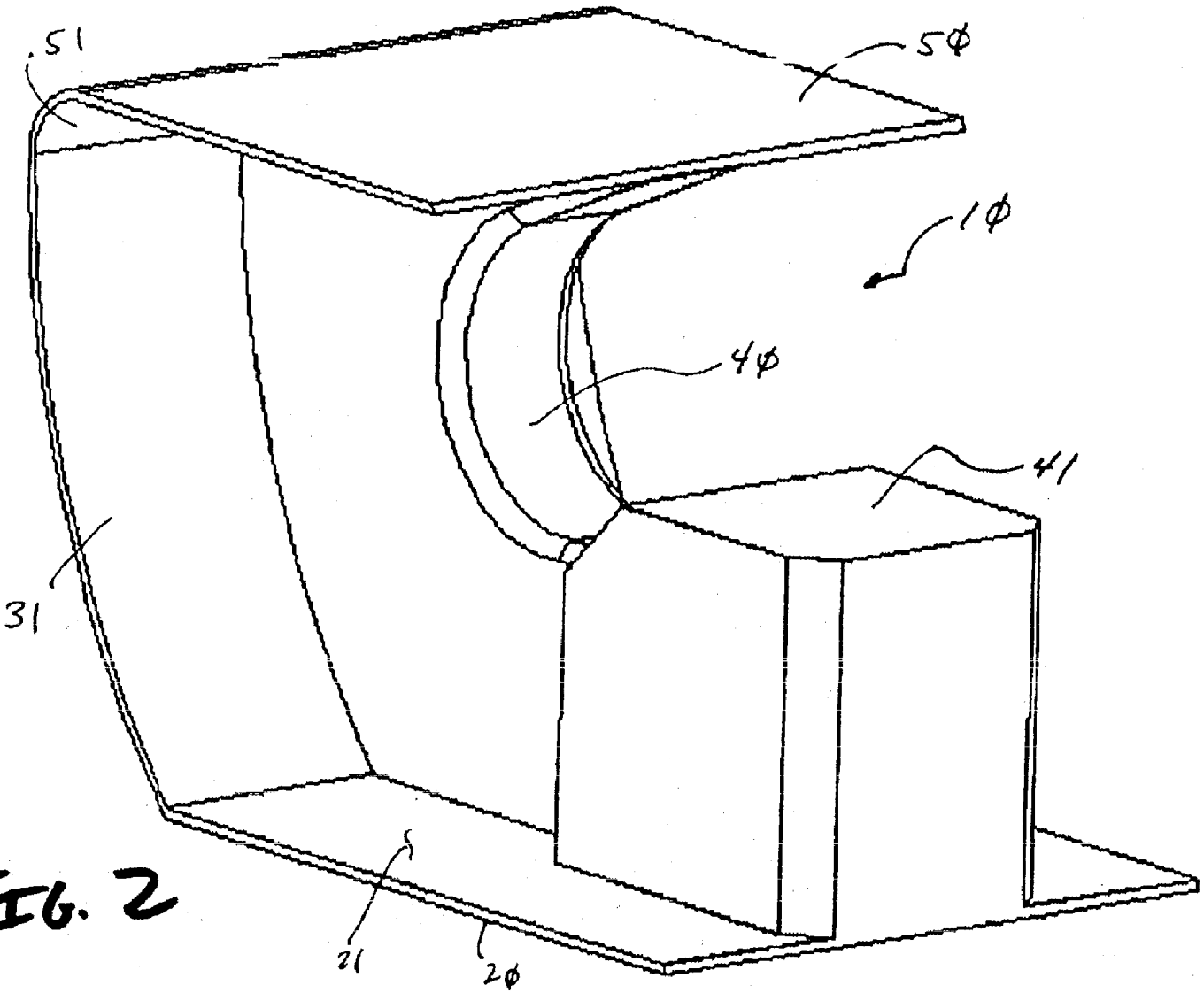
FIG. 2 is a left front perspective view of the embodiment shown in FIG. 1.
Figure 3:
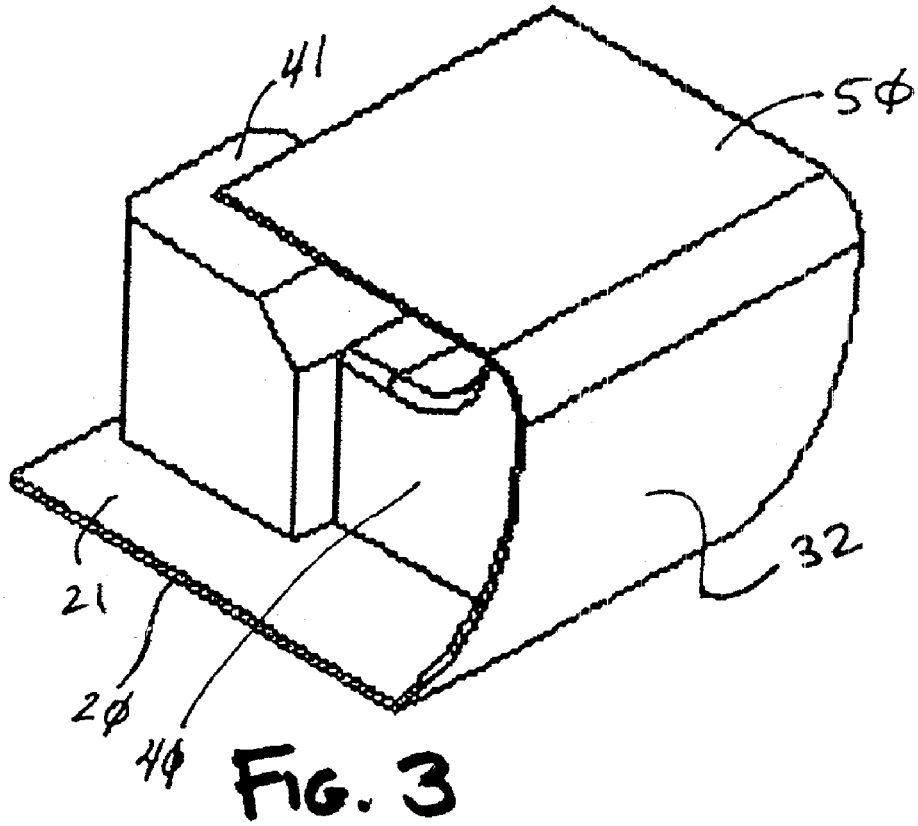
FIG. 3 is a top perspective view of the embodiment shown in FIG. 1.
Figure 4:
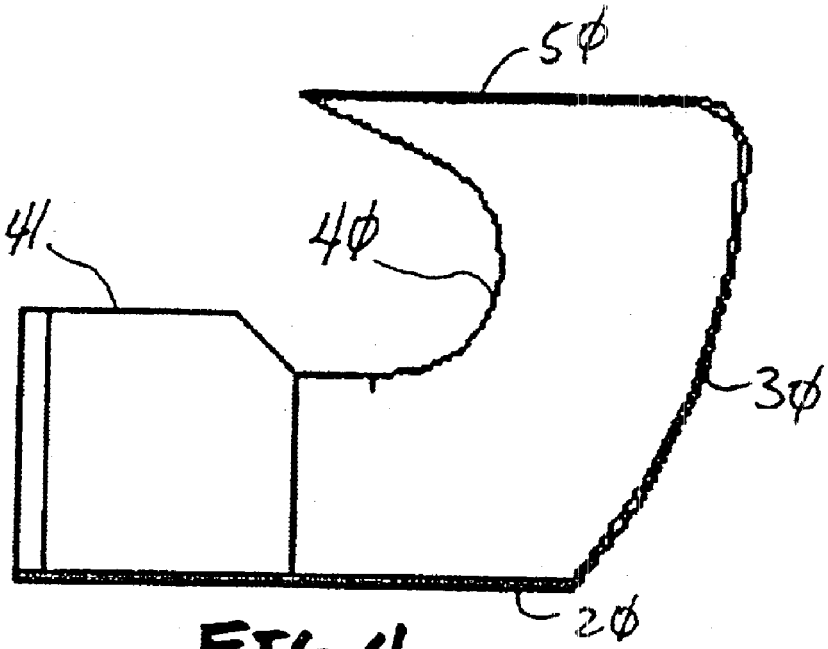
FIG. 4 is a right elevation view of the embodiment shown in FIG. 1.
Figure 5:
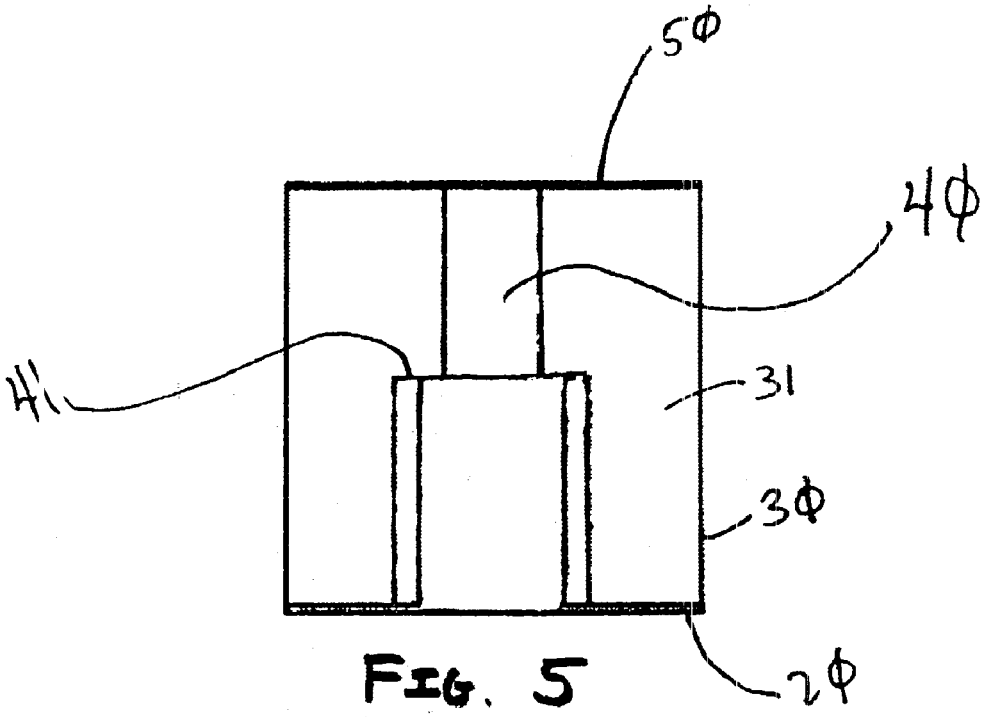
FIG. 5 is a front elevation view of the embodiment shown in FIG. 1.
Figure 6:
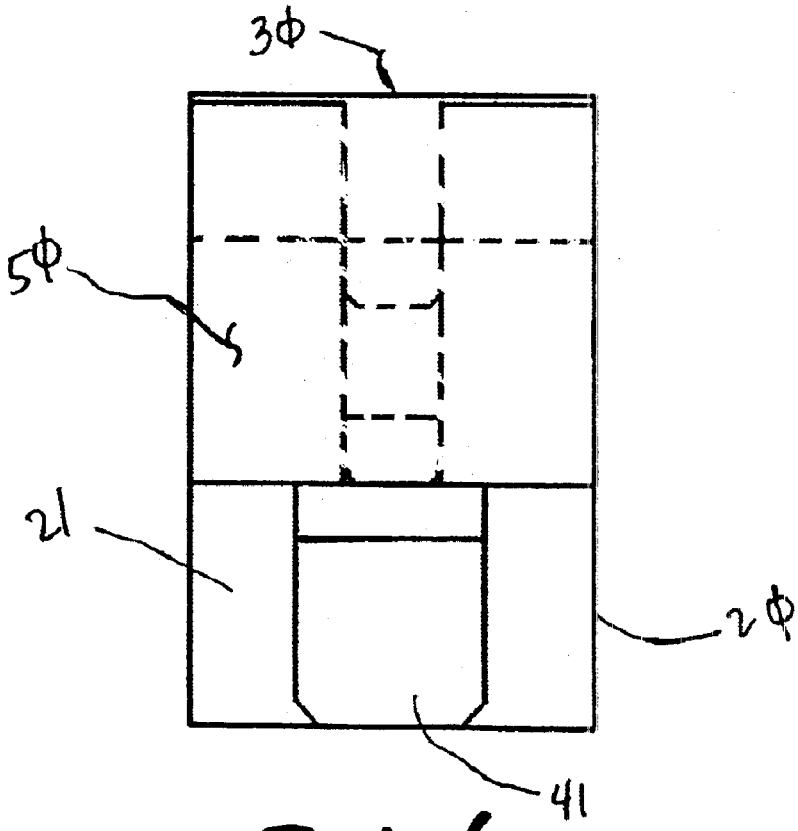
FIG. 6 is a top plan view of the embodiment shown in FIG. 1.

Referring now to FIGS. 1–9 a multi-functional furniture unit is shown herein. More specifically, a furniture unit 10 which includes a base member 20, a curved member 30, a support member 40, and a top member 50 is shown. The unit 10 is adapted to be positioned in a plurality if orientations, thereby providing the user with a toy, rest area, or a workspace for example.

As stated briefly above, the present invention preferably employs the interconnection of four basic members, the base 20, the curved 30, the support 40, an the top 50. Each of said members further includes at least inner and outer surfaces. The curved member 30 is interconnected to and provides a bridge between both the top 50 and the base 20 members such that the invention, when viewed from the side, is generally u-shaped. Furthermore, the curved member 30, in some configurations, also acts as a support for the top 50 and/or the base 20. In addition, in one embodiment, the width of the top 50, the base 20 and the curved 30 members are substantially equal. It should be noted, however, that it is contemplated to use a top 50, a base 20, and a curved 30 members of varying widths. The length of the base 20 and the top 50 can be of any dimension. However, one embodiment of the present invention the top 50 is slightly shorter than that of the base 20. Preferably, the length of the top 50 ranges from to at least about ⅓ of the length of the base 20 to at least about ¾ of the length of the base 20. However in one embodiment of the present invention, the length of the top 50 is approximately ½ the length of the base 20.

The support member 40 is attached to the inner surface 21 of the base 20. The support member 40 extends along the inner surface 31 of the curved member 30 and the inner surface 51 of the top 50. The support member 40, in one embodiment of the present invention, is a fraction of the width of the base 20 or the top 50. The width of the support member 40 is chosen based on the amount of support needed by the base and the top, which is ascertained generally from the weight of materials to be used, the unit's 10 intended uses, average weight of users, and other factors understood by one skilled in the art. For example, in one embodiment of the invention the width of the support member 40 ranges from at least about ¼ of the width of the base 20 to at least about ¾ of the width of the base 40. In another embodiment of the invention the width of the support member 40 is approximately ½ of the width of the base 20 and top 50.

The support member 40, in one embodiment, preferably includes a seat section 41 and a curved upper surface 42 which generally tracks the curvature of the curved member 30. The upper surface of the seat section 41 is preferably shaped substantially square or rectangular, however, it will be appreciated by one of ordinary skill in the art that the geometry of the seat section is an aesthetic choice and that any geometry, including a circle, a triangle, a hexagon, etc., will suffice. The curvature of the curved member 30 should be such that, when the unit 10 is placed on the floor such that the curved member 30 is positioned in contact with the floor, the invention will be capable of a rocking motion without flipping or tipping over. Thus, it is possible to have a curved surface 30 with a range of radii of curvature that varies with size, intended use of the unit 10, weight of materials, weight of users, etc. Alternatively, the curved member may also be convex with respect to the base 20 and the top 50, thereby providing a unit 10 that would be incapable of rocking. This alternative embodiment could be used as a toy that simulates a car, airplane, etc. perhaps with colorful depictions of controls thereof.

It is contemplated that the invention will be made of a rigid material that is capable of supporting the weight of users. Such materials can include but are not limited to fiberglass, carbon composite, steel, plastic, or wood. It is also contemplated that the invention can be made having a soft shell with a densely packed foam inside such that the foam will not deform when the weight of the user or users is applied to the unit 10. The soft shell can be made from any suitable material including but not limited to rubber, leather, vinyl, or a durable cloth. It is further contemplated that the invention can also be made having a rigid shell with a densely packed foam inside such that the foam will provide support for the shell to ensure that the shell does not fracture or break. The rigid shell can be made from any suitable material including but not limited to fiberglass, carbon fiber composite, press board, wood, or plastic. The unit 10 could also have surfaces treated with coatings that resist fluids, stains, bacterium, fire, mold, and other undesirable contaminants or hazards. Of course, it is additionally contemplated that the invention can be made in any color of the user's choosing.

Figure 7:
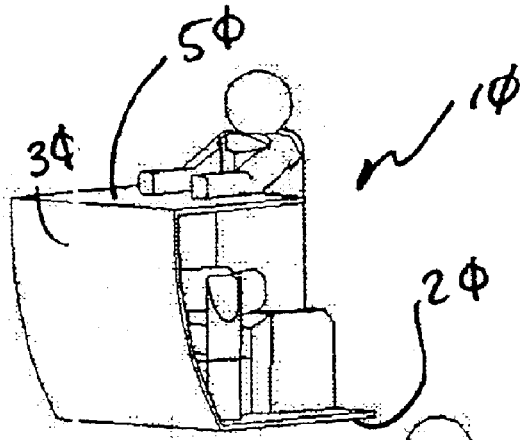
FIG. 7 is a perspective view of one embodiment of the present invention in the described desk configuration.

Referring now to FIG. 7, one embodiment of the present invention is shown herein adapted to be used as a desk. To use the unit 10 as a chair, the user need only turn around on the seat section 41 of the support member 40 such that the user's back is placed against the top 50 of the unit 10. In this configuration, the base 20 is in contact with the floor, while the curved member 30 extends upwards from the floor to meet and provide support for the top member 50.

Figure 8:
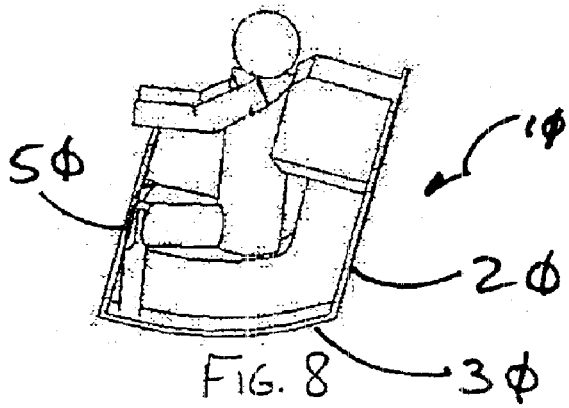
FIG. 8 is a perspective view of one embodiment of the present invention in the described rocking chair configuration.

Referring now to FIG. 8, one embodiment of the present invention is shown herein which is adapted to be used as a toy that is capable of at least rocking motion. In this configuration, the curved member 30 is in selective contact with the floor, while the base 20 and the top 50 members extend upward from the curved member 30. The user sits on the curved upper surface 42 of the support member 40 and, due to the shape of the curved member 30, is able to rock back and forth. The top 50 provides a place for the user to hold on to the invention while rocking.

Figure 9:
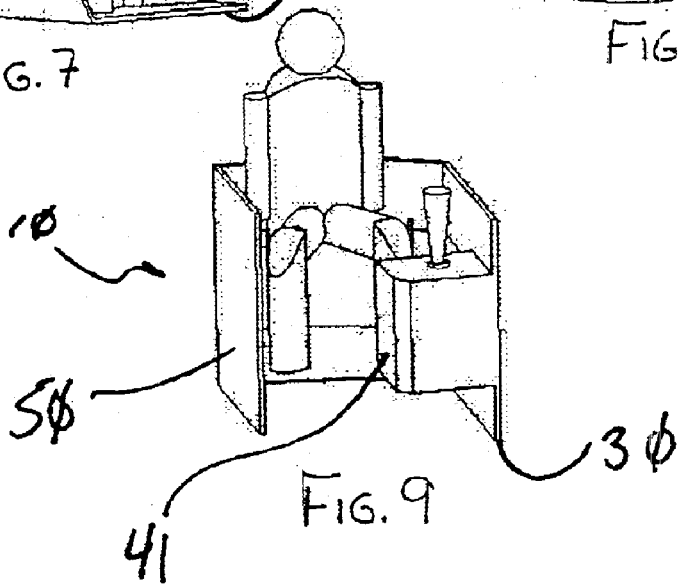
FIG. 9 is a perspective view of one embodiment of the present invention in the described sofa configuration.

Referring now to FIG. 9, one embodiment of the present invention is shown herein which is adapted to be used as a sofa or love seat. In this configuration, one of the sides of the curved 30, top 50, and base 20 members is in contact with the floor. The support member 40 is thus spaced apart and in a generally parallel orientation to the floor. The user is able to sit on one side of the support member 40 as shown and can use the upwardly-facing surface of the seat section 41 of the support member 40 to hold drinks, snacks or other items. Depending on the physical dimensions of the invention, the sofa configuration could accommodate two or more users.

It is contemplated that the invention will comprise a single integral piece. However, one of ordinary skill in the art will appreciate how to construct the device from several parts using conventional joining elements and joining techniques. It is also contemplated that one embodiment of the present invention will have physical dimensions and weight characteristics that will make the invention difficult for a small user to manipulate on their own to prevent injury. As the user grows, it is contemplated that the invention will be easy enough for a larger user to manipulate. However, it should be noted that the physical dimensions of the invention can vary according to the needs/wishes of the parents and the user.

To assist in the understanding of the present invention the following list of components and associated numbering found in the drawings is provided herein:

| Component | # |
|---|---|
| Multi-functional furniture unit | 10 |
| Base member | 20 |
| Inner base surface | 21 |
| Outer base surface | 22 |
| Curved member | 30 |
| Inner curved surface | 31 |
| Outer curved surface | 32 |
| Support member | 40 |
| Seat section | 41 |
| Curved upper surface | 42 |
| Top member | 50 |
| Inner top surface | 51 |
| Outer top surface | 52 |

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A furniture unit comprising:

a base member defined by a width and a length and having an inner surface and an outer surface;

a top member defined by a width and a length and having an inner surface and an outer surface;

a curved member defined at least by a width, which operably interconnects said base member to said top member, said curved member having an inner surface and an outer surface;

a support member interconnected to said inner surface of said base, said inner surface of said curved member, and said inner surface of said top member, said support member comprising:

a) a first portion positioned substantially in the middle of said base member and having a first width that is less than or equal to said width of said base member, b) a second portion, interconnected to said first portion of said support, positioned substantially in the middle of said base member and having a second width that is less than or equal to said width of said base member and equal to or greater than said first width, and c) a third portion positioned substantially in the middle of said curved member and having a third width that is less than or equal to said width of said curved member;

wherein said furniture unit may be oriented as a chair when said outer surface of said base member is engaged on a substantially horizontal surface such that said second portion of said support provides a seat for the user and said top member provides a backrest for the user;

wherein said furniture unit may be oriented as a sofa when said base member, said top member, and said curved member are positioned substantially perpendicular to the substantially horizontal surface such that said first portion of said support provides a seat for the user and said second portion of said support provides a table for the user;

wherein said furniture unit may be oriented as a desk when said outer surface of said base member is engaged on a substantially horizontal surface such that said second portion of said support provides a seat for the user and said outer surface of said top member provides a writing surface for the user; and wherein said furniture unit may be oriented as a rocking toy when said outer surface of said curved member is operably engaged on the substantially horizontal surface such that said third portion of said support member provides a seat for the user.

2. The furniture unit described in claim 1 wherein said length of said top member is less than or equal to said length of said base member.

3. The furniture unit described in claim 1 wherein the width of said top member, the width of said curved member, and the width of said base member are substantially equal.

4. The furniture unit described in claim 1 wherein said third portion of said support member has an arcuate shape.

5. The furniture unit described in claim 4 wherein said second portion has a geometric configuration different than the geometric configuration of said first portion.

6. The furniture unit according to claim 1 wherein interconnections of said base member, said top member, said curved member, and said support member define a single, integral, one-piece structure.

7. The furniture unit according to claim 1 wherein interconnections of said base member, said top member, said curved member, and said support member define a multiple piece structure that is adapted to selective interconnect.

8. The furniture unit described in claim 1 wherein said base member, said curved member, and said top member are interconnected in a generally U-shaped arrangement.

9. A multi-functional furniture unit comprising:

a generally rectangular top member, defined by a width and a length, having an inner surface and an outer surface;

a generally rectangular base member, defined by a width and a length, having an inner surface and an outer surface, wherein said top member is positioned in proximity to said bottom surface at a predetermined distance;

a curved member, defined at least by a width, which spans from said top member to said base member thereby operably interconnecting said top member and said base member; and a support member interconnected to said top member, said base member, and said curved member, said support member comprising:

a) a first portion positioned substantially in the middle of said base member and having a first width that is less than or equal to said width of said base member, b) a second portion, interconnected to said first portion of said support, positioned substantially in the middle of said base member and having a second width less than or equal to said width of said base member and equal to or greater than said first width, and c) a third portion positioned substantially in the middle of said curved member and having a third width that is less than or equal to said width of said curved member.

10. The furniture unit according to claim 9 wherein said furniture unit may be oriented as a chair when said outer surface of said base member is engaged on a substantially level surface such that said second portion of said support provides a seat for the user and said top member provides a backrest for the user;

wherein said furniture unit may be oriented as a sofa when said base member, said top member, said curved member are positioned substantially perpendicular to the substantially level surface such that said first portion of said support provides a seat for the user and said second portion of said support provides a table for the user;

wherein said furniture unit may be oriented as a desk when said outer surface of said base member is engaged on the substantially level surface such that said second portion of said support provides a seat for the user and said outer surface of said top member provides a writing surface for the user; and wherein said furniture unit may be oriented as a rocking toy when said curved surface is operably engaged on the substantially level surface such that said third portion of said support member provides a seat for the user.

11. The furniture unit of claim 9, wherein said curved member employs a radius of curvature and a width that substantially prevents tipping or flipping of said furniture unit when it is being used as a rocking toy.

12. The furniture unit of claim 9, wherein said top member, said base member, and said curved members employ geometry which substantially prevents tipping or flipping by a child user of the unit when it is oriented to provide a desk, a sofa, or a chair.

13. The furniture unit of claim 9, wherein said curved member is oriented in such a way to substantially prevent a rocking motion when said curved member is placed adjacent the a substantially level surface and said top member and said base members are oriented substantially perpendicular to the substantially level surface.

14. The furniture unit according to claim 9 wherein an inner surface of said top member and an inner surface of said base member are substantially parallel.

15. A method of constructing a multi-functional furniture unit comprising:

positioning a top member of a first width a predetermined distance from a base member of a second width;

operably interconnecting said top and base members with only one third member of a third width;

providing a support member of a fourth width that is interconnected to said base, top, and third members substantially in the center of said first width, said second width, and said third width, wherein said unit is generally U-shaped such that the unit is adapted to be either stationary or capable of a rocking motion.

16. The method of constructing a multi-functional furniture unit of claim 5, wherein said third member is substantially curved such that when it is placed in contact with a substantially planar surface it is adapted to rock or sway.

17. The method of constructing a multi-functional furniture unit of claim 15, wherein said support member further includes a seat section.

18. The method of constructing a multi-functional furniture unit of claim 15, wherein said first width, said second width, and said third width are substantially equal.

19. The method of constructing a multi-functional furniture unit of claim 15, wherein said forth width is less than or equal to at least one of said first width, said second width, and said third width.

20. The method of constructing a multi-functional furniture unit of claim 15, wherein said third member is arcuate.

* * * * *